US009841018B2

(12) United States Patent
Sakai et al.

(10) Patent No.: US 9,841,018 B2
(45) Date of Patent: Dec. 12, 2017

(54) FLUID PUMP

(71) Applicant: DENSO CORPORATION, Kariya, Aichi-pref. (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 101 days.

(21) Appl. No.: 15/096,625

(22) Filed: Apr. 12, 2016

(65) Prior Publication Data

US 2016/0298624 A1 Oct. 13, 2016

(30) Foreign Application Priority Data

Apr. 13, 2015 (JP) ..... 2015-81915

(51) Int. Cl.

| | |
|---|---|
| ***F03C 4/00*** | (2006.01) |
| ***F04C 2/00*** | (2006.01) |
| ***F04C 2/10*** | (2006.01) |
| ***F04C 15/06*** | (2006.01) |
| ***F02M 37/10*** | (2006.01) |
| *F04C 2/08* | (2006.01) |

(52) U.S. Cl.

CPC ..... *F04C 2/102* (2013.01); *F02M 37/10* (2013.01); *F04C 2/086* (2013.01); *F04C 15/06* (2013.01); *F04C 2/084* (2013.01); *F04C 2210/1044* (2013.01); *F04C 2250/101* (2013.01)

(58) Field of Classification Search

CPC ..... F04C 2250/00; F04C 2250/10; F04C 2250/101; F04C 2250/102; F04C 2250/20

See application file for complete search history.

(56) References Cited

U.S. PATENT DOCUMENTS

| | | | | |
|---|---|---|---|---|
| 6,896,500 | B2 * | 5/2005 | Ike | F04C 2/086 418/15 |
| 8,333,576 | B2 * | 12/2012 | Rytlewski | F04C 2/3442 417/310 |
| 9,581,156 | B2 * | 2/2017 | Torii | F04C 2/102 |

FOREIGN PATENT DOCUMENTS

| | | |
|---|---|---|
| JP | 2009-174448 | 8/2009 |
| JP | 2012-189011 | 10/2012 |
| JP | 2013-60901 | 4/2013 |

* cited by examiner

*Primary Examiner* — Mark Laurenzi
*Assistant Examiner* — Anthony Ayala Delgado
(74) *Attorney, Agent, or Firm* — Nixon & Vanderhye PC

(57) ABSTRACT

A suction groove is formed in an inside wall surface of a pump cover and is communicated with a suction passage of the pump cover. The suction groove extends along a rotational path of external teeth of an inner rotor and a rotational path of internal teeth of an outer rotor. An edge of a portion of the pump cover, which forms the suction groove, includes chamfered edge parts, which are chamfered, and unchamfered edge parts, which are not chamfered and are not rounded. Each of the unchamfered edge parts is located in a direct-inflow region of the suction groove, which overlaps with the suction passage in a view taken in a direction of a rotational axis, and each of the chamfered edge parts is located in a corresponding one of peripheral regions, which are other than the direct-inflow region.

4 Claims, 7 Drawing Sheets

FLUID PUMP

CROSS REFERENCE TO RELATED APPLICATION

This application is based on and incorporates herein by reference Japanese Patent Application No. 2015-81915 filed on Apr. 13, 2015.

TECHNICAL FIELD

The present disclosure relates to a fluid pump that draws and discharges fluid by changing a volume of respective pump chambers formed between external teeth of an inner rotor and internal teeth of an outer rotor.

BACKGROUND

A previously proposed fluid pump has an inner rotor, an outer rotor and a pump housing. The inner rotor includes external teeth, and the outer rotor includes internal teeth for meshing with the external teeth. The pump housing receives the inner rotor and the outer rotor. When the inner rotor is rotated, a rotational force of the inner rotor is transmitted from the external teeth to the internal teeth. Thereby, the outer rotor is also rotated. When the inner rotor and the outer rotor are rotated, the volume of the respective pump chambers, which are formed between the external teeth and the internal teeth, changes. In response to increasing of the volume of the pump chamber, the fluid is drawn into the pump chamber through a suction passage formed in the pump housing. Thereafter, in response to decreasing of the volume of the pump chamber, the fluid is compressed in the pump chamber and is discharged from the pump chamber.

A suction groove, which is communicated with the suction passage, is formed in an inside wall surface of the pump housing. The suction groove is shaped to extend along a rotational path of the external teeth and a rotational path of the internal teeth, and the suction groove increases a radial extent of a fluid passage, through which the fluid is supplied from the suction passage into the pump chamber (see, for example, JP2013-60901A).

Various developments have been made to improve the pump efficiency of the fluid pump through elaborations on, for example, configurations of the suction groove and the suction passage. Lately, demand for energy saving has been progressively increased, and thereby a further improvement of the pump efficiency has been demanded.

SUMMARY

The present disclosure is made in view of the above point. According to the present disclosure, there is provided a fluid pump that includes an inner rotor, an outer rotor, a pump housing, a suction passage, and a suction groove. The inner rotor has a plurality of external teeth. The outer rotor has a plurality of internal teeth for meshing with the plurality of external teeth. The pump housing receives the outer rotor and the inner rotor and forms a plurality of pump chambers, each of which has a variable volume, between the plurality of internal teeth and the plurality of external teeth. The suction passage is formed in the pump housing and conducts the fluid to be drawn into at least one of the plurality of pump chambers. The suction groove is formed in an inside wall surface of the pump housing and is communicated with the suction passage while the suction groove is shaped to extend along a rotational path of the plurality of external teeth and a rotational path of the plurality of internal teeth. An edge of the suction groove has both of a chamfered edge part, which is chamfered, and an unchamfered edge part, which is not chamfered and is not rounded. The unchamfered edge part is located in a direct-inflow region of the suction groove, which overlaps with the suction passage in a view taken in a direction of a rotational axis. The chamfered edge part is located in a peripheral region of the suction groove, which is other than the direct-inflow region.

BRIEF DESCRIPTION OF THE DRAWINGS

The drawings described herein are for illustration purposes only and are not intended to limit the scope of the present disclosure in any way.

DETAILED DESCRIPTION

An embodiment of a fluid pump according to the present disclosure will be described with reference to the accompanying drawings. The fluid pump of the present embodiment is installed in a vehicle. A subject fluid to be pumped with the fluid pump is liquid fuel used for combustion in an internal combustion engine. Specifically, in the present embodiment, light oil (diesel fuel), which is used for combustion in a compression self-ignition internal combustion engine, is used as the subject fluid to be pumped. The fluid pump is received in an inside of a fuel tank.

Figure 1:
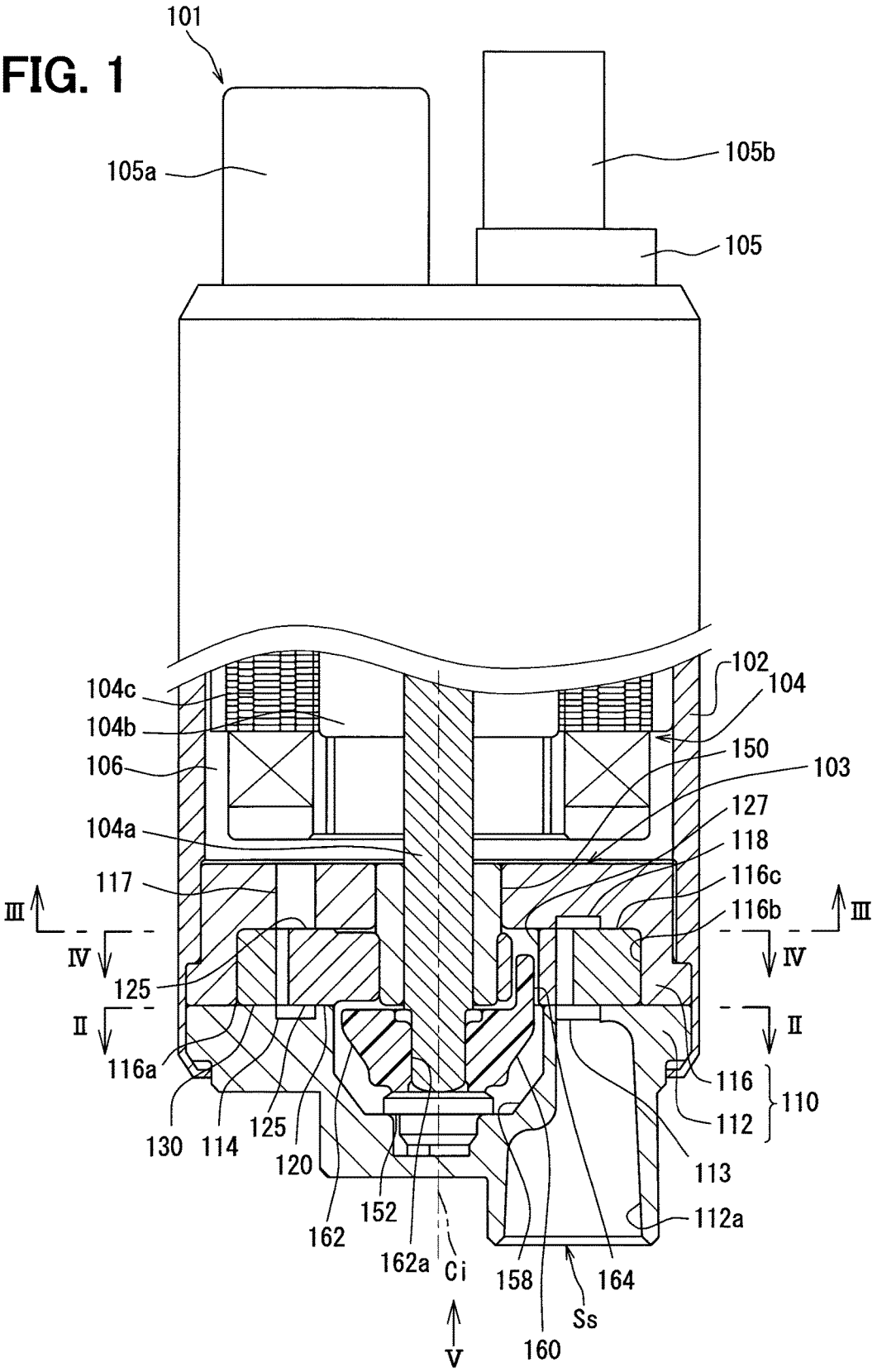
FIG. 1 is a partial cross-sectional view indicating a fuel pump according to an embodiment of the present disclosure.

As shown in FIG. 1, the fluid pump 101 of the present embodiment is a rotary internal gear pump of a positive displacement type. The fluid pump 101 includes a pump body 102, a pump main body 103, an electric motor 104 and a side cover 105. The pump main body 103 and the electric motor 104 are received in an inside of the pump body 102, which is shaped into a cylindrical tubular form, such that the pump main body 103 and the electric motor 104 are arranged one after another in an axial direction. The side cover 105 is installed to an opening of one of two axially opposite end parts of the pump body 102, which is located on the electric motor 104 side.

The side cover 105 includes an electric connector 105*a*, which supplies an electric power to the electric motor 104, and a discharge port 105*b*, through which fuel is discharged from the fluid pump 101. In the fluid pump 101, a rotatable shaft 104*a* of the electric motor 104 is rotated when the electric power is supplied from an external circuit through the electric connector 105*a*. Thus, an outer rotor 130 and an inner rotor 120 of the pump main body 103 are rotated by a drive force of the rotatable shaft 104*a* of the electric motor 104, and thereby fuel is drawn into and compressed in the fluid pump 101 and is then discharged from the fluid pump 101 through the discharge port 105*b*. The fluid pump 101 pumps the light oil, which has the higher viscosity in comparison to gasoline, as the fuel.

In the present embodiment, the electric motor 104 is an inner rotor brushless motor and includes magnets 104*b*, which form four magnetic poles, and coils 104*c*, which are installed in six slots. For example, at a start preparation time (e.g., a time of turning on of an ignition switch of the vehicle), a positioning control operation of the electric motor 104 is executed to rotate the rotatable shaft 104*a* toward a drive rotation side or a counter-drive rotation side (the counter-drive rotation side being opposite from the drive rotation side). Thereafter, the electric motor 104 executes a drive control operation, which rotates the rotatable shaft 104*a* from the position, at which the rotatable shaft 104*a* is positioned in the positioning control operation, toward the drive rotation side.

Here, the drive rotation side is a positive direction side of a rotational direction Ri of the inner rotor 120 in a circumferential direction of the inner rotor 120. The counter-drive rotation side is a negative direction side of the rotational direction Ri of the inner rotor 120, which is opposite from the positive direction side.

Hereinafter, the pump main body 103 will be described in detail. The pump main body 103 includes a pump housing 110, the inner rotor 120, the outer rotor 130 and a joint member 160. The pump housing 110 includes a pump cover 112 and a pump casing 116, which are placed one after another in the axial direction.

The pump cover 112 is made of metal and is shaped into a circular disk form. The pump cover 112 axially projects outward from the end part of the pump body 102, which is located on the side of the electric motor 104 that is opposite from the side cover 105.

Figure 2:
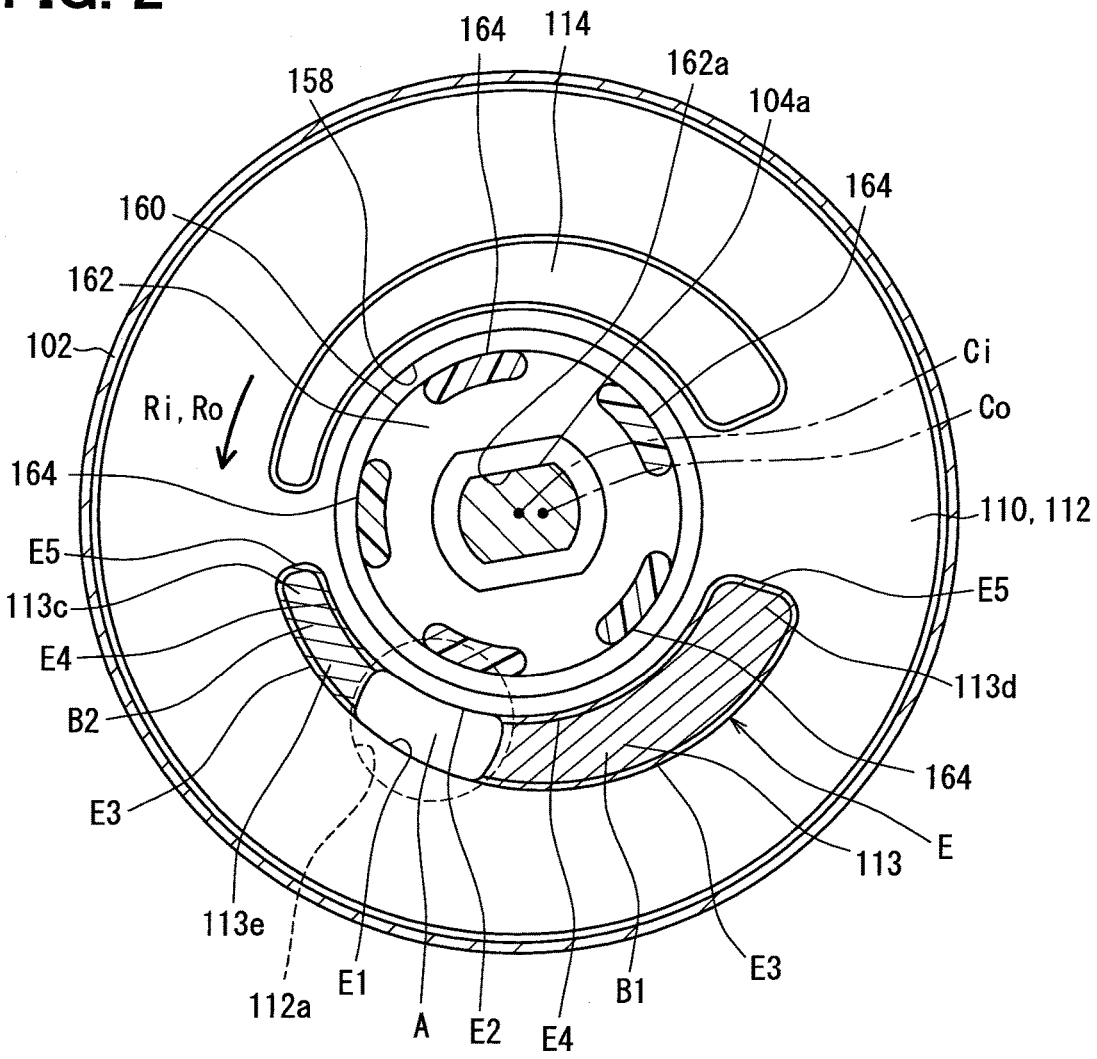
FIG. 2 is a cross-sectional view taken along line II-II in FIG. 1.

In order to draw the fuel from an outside of the fluid pump 101, the pump cover 112 shown in FIGS. 1 and 2 has a suction passage 112*a*, which is formed as a cylindrical hole, and a suction groove 113, which is shaped into an arcuate form. In the pump cover 112, the suction passage 112*a* is communicated with the suction groove 113 at a predetermined opening location Ss, which is eccentric from a central axis (hereinafter referred to as an inner central axis) Ci of the inner rotor 120. The suction groove 113 is axially grooved, i.e., formed in an inside wall surface of the pump cover 112 and opens on the pump casing 116 side of the pump cover 112. A communicating portion of the suction groove 113, which is communicated with the suction passage 112*a*, extends through the pump cover 112 in the axial direction. A non-communicating portion of the suction groove 113, which is not directly communicated with the suction passage 112*a*, is shaped into a cup form having a bottom. As shown in FIG. 2, the suction groove 113 has a circumferential extent, which is less than one half (less than 180 degrees) of an entire circumference of the inner rotor 120 in the rotational direction Ri (also see FIG. 4). Shaded areas, which are indicated by reference signs B1, B2 in FIG. 2, do not represent a cross-section but represent extents of peripheral portions 1132, respectively, which will be described later.

The suction groove 113 extends from a start end part 113*c* to a terminal end part 113*d* in the rotational direction Ri, Ro such that a radial extent (hereinafter referred to as a width) of the suction groove 113, which is measured in a radial direction of the rotational axis, progressively increases in the rotational direction Ri, Ro from the start end part 113*c* to the terminal end part 113*d*. The suction passage 112*a* opens in a groove bottom portion 113*e* of the suction groove 113 at the opening area Ss, so that the suction groove 113 is communicated with the suction passage 112*a*. As shown particularly in FIG. 2, in an entire range of the opening area Ss, in which the suction passage 112*a* opens, the width of the suction groove 113 is smaller than a width (diameter) of the suction passage 112*a*.

Furthermore, the pump cover 112 forms an installation space 158 at an area that is opposed to the inner rotor 120 along the inner central axis Ci. The installation space 158 is shaped into a recessed hole. A main body 162 of the joint member 160 is rotatably installed in the installation space 158.

The pump casing 116 shown in FIGS. 1, 3, 4 and 5 is made of metal and is shaped into a cylindrical tubular form having a bottom. An opening portion 116*a* of the pump casing 116 is covered with the pump cover 112 such that an entire circumferential extent of the opening portion 116*a* is tightly closed by the pump cover 112. As shown particularly in FIGS. 1 and 4, an inner peripheral portion 116*b* of the pump casing 116 is formed as a cylindrical hole that is eccentric relative to the inner central axis Ci of the inner rotor 120.

Figure 3:
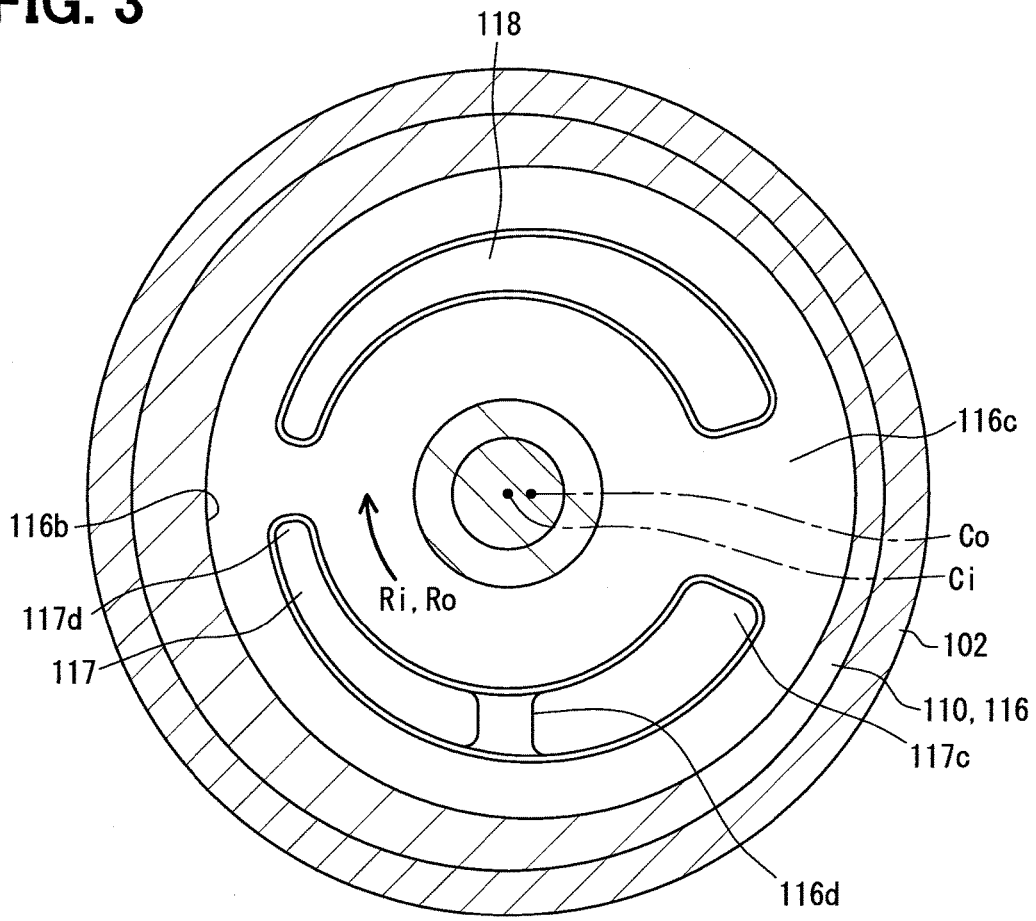
FIG. 3 is a cross-sectional view taken along line III-III in FIG. 1.

The pump casing 116 forms a discharge passage 117, which is formed as an arcuate hole, to discharge the fuel from the discharge port 105*b* through a high pressure passage 106 defined between the pump body 102 and the electric motor 104. The discharge passage 117 axially extends through a recessed bottom portion 116*c* of the pump casing 116. Particularly, as shown in FIG. 3, the discharge passage 117 has a circumferential extent, which is less than one half (i.e., less than 180 degrees) of the entire circumference of the inner rotor 120 in the rotational direction Ri. A radial extent (hereinafter referred to as a width) of the discharge passage 117, which is measured in the radial direction, progressively decreases in the rotational direction Ri, Ro from a start end part 117*c* to a terminal end part 117*d*.

Furthermore, the pump casing 116 includes a reinforcing rib 116*d* in the discharge passage 117. The reinforcing rib 116*d* is formed integrally with the pump casing 116 such that the reinforcing rib 116*d* extends across the discharge passage 117 in a crossing direction, which crosses the rotational direction Ri of the inner rotor 120, and thereby the reinforcing rib 116*d* reinforces the pump casing 116.

An opposing suction groove 118 shown in FIG. 3 is formed in the recessed bottom portion 116*c* of the pump casing 116 at a corresponding area that is opposed to the suction groove 113 in the axial direction while pump chambers 140 (described later in detail) are interposed between the opposing suction groove 118 and the suction groove 113 in the axial direction. The opposing suction groove 118 is an arcuate groove that corresponds to a shape, which is produced by projecting the suction groove 113 onto the pump casing 116 in the axial direction. In this way, in the pump casing 116, the discharge passage 117 is formed to be symmetric to the opposing suction groove 118 with respect to the symmetry axis located between the discharge passage 117 and the opposing suction groove 118. As shown particularly in FIG. 2, an opposing discharge groove 114 is formed in the pump cover 112 at a corresponding area that is opposed to the discharge passage 117 in the axial direction while the pump chambers 140 are interposed between the opposing discharge groove 114 and the discharge passage 117 in the axial direction. The opposing discharge groove 114 is formed as an arcuate groove that is shaped to correspond with a shape, which is produced by projecting the discharge passage 117 onto the pump cover 112 in the axial direction. In this way, in the pump cover 112, the suction groove 113 is formed to be symmetric to the opposing discharge groove 114 with respect to the symmetry axis located between the suction groove 113 and the opposing discharge groove 114.

As shown in FIG. 1, a radial bearing 150 is securely fitted to the recessed bottom portion 116*c* of the pump casing 116 along the inner central axis Ci to radially support the rotatable shaft 104*a* of the electric motor 104 in a manner that enables rotation of the rotatable shaft 104*a*. Furthermore, a thrust bearing 152 is securely fitted to the pump cover 112 along the inner central axis Ci to axially support the rotatable shaft 104*a* in a manner that enables the rotation of the rotatable shaft 104*a*.

Figure 4:
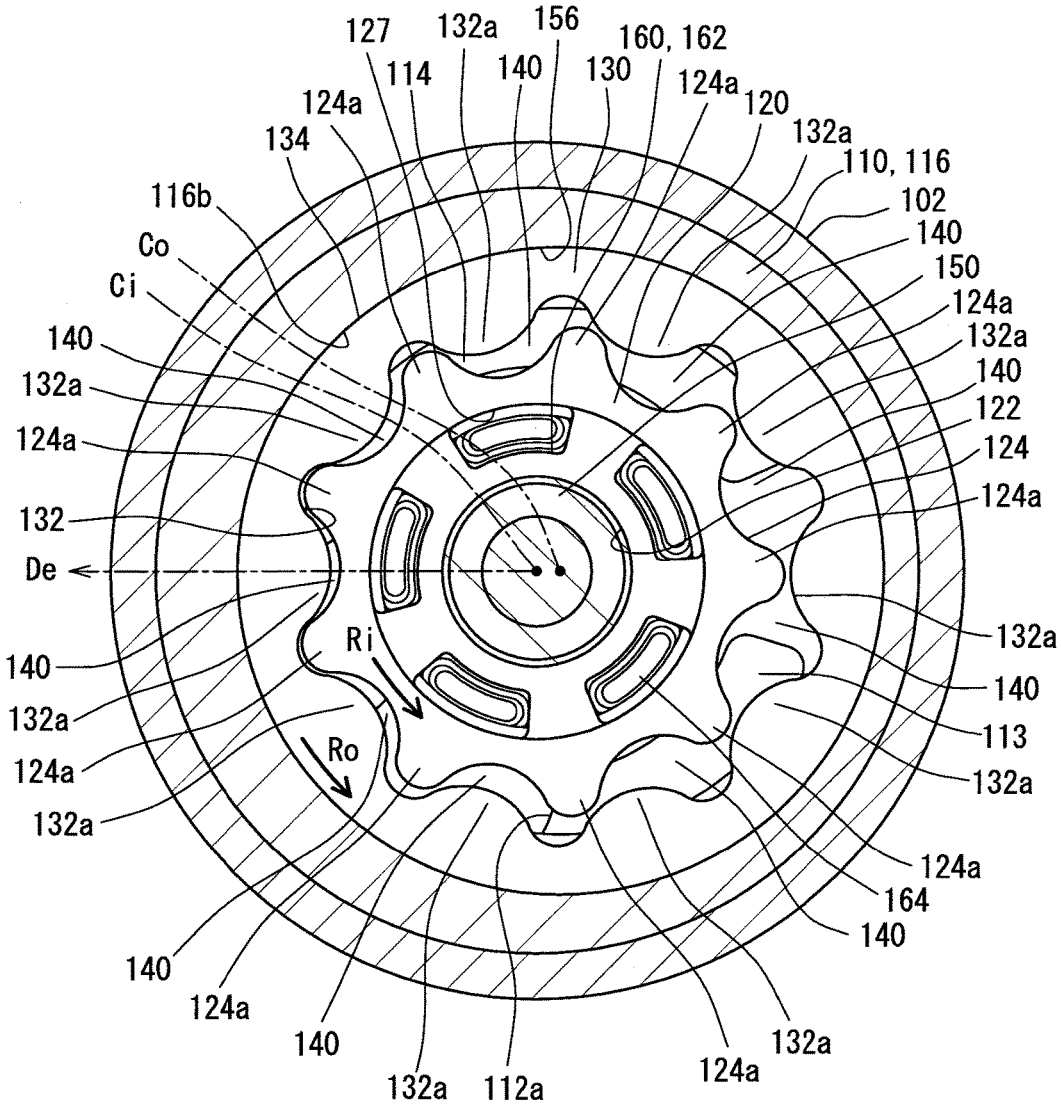
FIG. 4 is a cross-sectional view taken along line IV-IV in FIG. 1.
Figure 5:
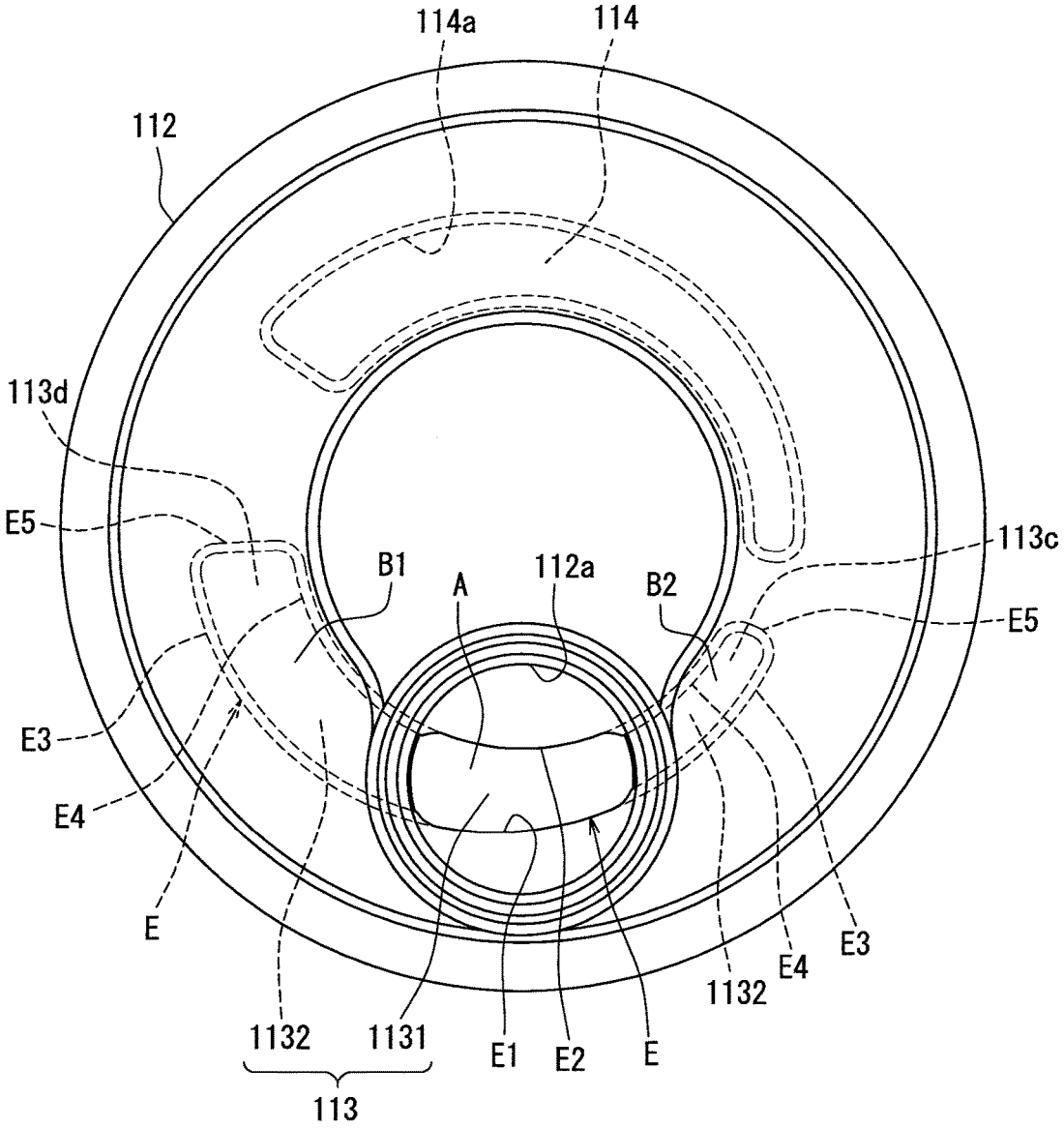
FIG. 5 is a view taken in a direction of an arrow V in FIG. 1.

As shown in FIGS. 1 and 4, a receiving space 156, which receives the inner rotor 120 and the outer rotor 130, is formed by the recessed bottom portion 116*c* and the inner peripheral portion 116*b* of the pump casing 116 and the pump cover 112.

The inner rotor 120, which is indicated in FIGS. 1 and 4 to 6, is centered at the inner central axis Ci and is thereby coaxial with the rotatable shaft 104*a* (i.e., coaxial with a rotational axis of the rotatable shaft 104*a*), so that the inner rotor 120 is eccentrically placed in the receiving space 156. An inner peripheral portion 122 of the inner rotor 120 is radially supported by the radial bearing 150, and two slide surfaces 125 of the inner rotor 120, which are respectively formed at two opposed axial ends of the inner rotor 120, are supported by the recessed bottom portion 116*c* of the pump casing 116 and the pump cover 112, respectively, in a manner that enables rotation of the inner rotor 120.

The inner rotor 120 has a plurality of insertion holes 127 that extend in the axial direction at a corresponding area of the inner rotor 120, which is opposed to the installation space 158. In the present embodiment, the number of the insertion holes 127 is five, and these insertion holes 127 are arranged one after another at equal intervals in the circumferential direction along the rotational direction Ri. The insertion holes 127 extend through the inner rotor 120 from the installation space 158 side to the recessed bottom portion 116*c* side in the axial direction. Legs (projections) 164 of the joint member 160 are inserted into the insertion holes 127, respectively, so that the drive force of the rotatable shaft 104*a* is transmitted to the inner rotor 120 through the joint member 160. Thereby, the inner rotor 120 is rotated in the circumferential direction about the inner central axis Ci in response to the rotation of the rotatable shaft 104*a* of the electric motor 104 while the slide surfaces 125 of the inner rotor 120 are slid along the recessed bottom portion 116*c* and the pump cover 112, respectively.

The inner rotor 120 includes a plurality of external teeth 124*a*, which are formed in an outer peripheral portion 124 of the inner rotor 120 and are arranged one after another at equal intervals in the circumferential direction along the rotational direction Ri. Each of the external teeth 124*a* can axially oppose the suction groove 113, the discharge passage 117, the opposing discharge groove 114 and the opposing suction groove 118 in response to the rotation of the inner rotor 120. Thereby, it is possible to limit sticking of the inner rotor 120 to the recessed bottom portion 116*c* and the pump cover 112.

As shown in FIGS. 1 and 4, the outer rotor 130 is eccentric to the inner central axis Ci of the inner rotor 120, so that the outer rotor 130 is coaxially received in the receiving space 156. In this way, the inner rotor 120 is eccentric to, i.e., is decentered from the outer rotor 130 in an eccentric direction De, which is the radial direction. An outer peripheral portion 134 of the outer rotor 130 is radially supported by the inner peripheral portion 116*b* of the pump casing 116 in a manner that enables rotation of the outer rotor 130. Furthermore, the outer peripheral portion 134 of the outer rotor 130 is axially supported by the recessed bottom portion 116*c* of the pump casing 116 and the pump cover 112 in a manner that enables the rotation of the outer rotor 130. The outer rotor 130 is rotatable in the rotational direction (certain rotational direction) Ro about an outer central axis Co, which is eccentric to the inner central axis Ci.

The outer rotor 130 has a plurality of internal teeth 132*a* for meshing with the external teeth 124*a* of the inner rotor 120. The internal teeth 132*a* are formed in an inner peripheral portion 132 of the outer rotor 130 and are arranged one after another at equal intervals in the rotational direction Ro. Each of the internal teeth 132*a* can axially oppose the suction groove 113, the discharge passage 117, the opposing discharge groove 114 and the opposing suction groove 118 in response to the rotation of the outer rotor 130. Thereby, it is possible to limit sticking of the outer rotor 130 to the recessed bottom portion 116*c* and the pump cover 112.

A fuel pressure (discharge pressure) in an inside of the discharge passage 117 is axially exerted against the inner rotor 120 and the outer rotor 130 toward the suction passage 112*a*. A fuel pressure in the opposing discharge groove 114 is also the discharge pressure and is axially exerted against the inner rotor 120 and the outer rotor 130 toward the electric motor 104 side. Since the opposing discharge groove 114 is axially opposed to the discharge passage 117, the fuel pressure of the opposing discharge groove 114 and the fuel pressure of the discharge passage 117 are balanced with each other. Therefore, it is possible to limit tilting of the inner rotor 120 and the outer rotor 130, which would be otherwise caused by the discharge pressure.

Similarly, since the opposing suction groove 118 is axially opposed to the suction groove 113, the fuel pressure (the suction pressure) of the opposing suction groove 118 and the fuel pressure (the suction pressure) of the suction groove 113 are balanced with each other. Therefore, it is possible to limit tilting of the inner rotor 120 and the outer rotor 130, which would be otherwise caused by the suction pressure.

The external teeth 124*a* and the internal teeth 132*a* are shaped to have a trochoid tooth profile. The number of the internal teeth 132*a* is set to be larger than the number of the external teeth 124*a* by one. The inner rotor 120 is meshed with the outer rotor 130 due to the eccentricity in the eccentric direction De. In this way, the pump chambers 140 are radially formed between the internal teeth 132*a* and the external teeth 124*a* in the receiving space 156. A volume of each pump chamber 140 is increased and decreased through the rotation of the outer rotor 130 and the rotation of the inner rotor 120.

The volume of each of opposing ones of the pump chambers 140, which are axially opposed to and communicated with the suction groove 113 and the opposing suction groove 118, is increased in response to the rotation of the inner rotor 120 and the rotation of the outer rotor 130. Thereby, the fuel is drawn from the suction passage 112*a* into the corresponding pump chambers 140 through the suction groove 113. At this time, since the width (radial extent) of the suction groove 113 progressively increases from the start end part 113*c* to the terminal end part 113*d* in the rotational direction Ri, Ro (also see FIG. 2), the amount of fuel drawn into the pump chamber 140 through the suction groove 113 corresponds to the amount of increase in the volume of the pump chamber 140.

The volume of each of opposing ones of the pump chambers 140, which are axially opposed to and communicated with the discharge passage 117 and the opposing discharge groove 114, is decreased in response to the rotation of the inner rotor 120 and the rotation of the outer rotor 130. Therefore, simultaneously with the suctioning function discussed above, the fuel is discharged from the corresponding pump chamber 140 into the high pressure passage 106 through the discharge passage 117. At this time, since the width (radial extent) of the discharge passage 117 progressively decreases from the start end part 117*c* to the terminal end part 117*d* in the rotational direction Ri, Ro (also see FIG. 3), the amount of fuel discharged from the pump chamber 140 through the discharge passage 117 corresponds to the amount of decrease in the volume of the pump chamber 140.

The joint member 160 is made of synthetic resin, such as poly phenylene sulfide (PPS). The joint member 160 relays the rotatable shaft 104*a* to the inner rotor 120 to rotate the inner rotor 120 in the circumferential direction. The joint member 160 includes the main body 162 and the legs 164.

The main body 162 is installed in the installation space 158, which is formed in the pump cover 112. A fitting hole 162*a* is formed in a center of the main body 162, and thereby the main body 162 is shaped into a circular ring form. When the rotatable shaft 104*a* is fitted into the fitting hole 162*a*, the main body 162 is securely fitted to the rotatable shaft 104*a* to rotate integrally with the rotatable shaft 104*a*.

The number of the legs 164 corresponds to the number of the insertion holes 127 of the inner rotor 120. Specifically, in order to reduce or minimize the influence of the torque ripple of the electric motor 104, the number of the legs 164 is different from the number of the magnetic poles and the number of the slots of the electric motor 104 and is thereby set to five (5), which is a prime number, in the present embodiment. The legs 164 axially extend from a plurality of locations (five locations in the present embodiment), respectively, on a radially outer side of the fitting hole 162*a*, which is a fitting location of the main body 162. The legs 164 are arranged one after another at equal intervals in the circumferential direction. Each leg 164 is resiliently deformable because of the resilient material and the axially elongated shape of the leg 164. When the rotatable shaft 104*a* is rotated, each leg 164 is flexed through the resilient deformation thereof in conformity with the corresponding insertion hole 127. Thereby, the leg 164 contacts an inner wall of the insertion hole 127 while absorbing circumferential dimensional errors of the insertion hole 127 and the leg 164 generated at the manufacturing. In this way, the joint member 160 transmits the drive force of the rotatable shaft 104*a* to the inner rotor 120 through the legs 164.

Next, the shape of the suction groove 113 will be described with reference to FIGS. 2 and 5 to 7.

As shown in FIGS. 2 and 5 to 7, an edge E of a portion of the pump housing 110, which forms the suction groove 113 (hereinafter referred to as an edge E of the suction groove 113), includes chamfered edge parts E3, E4, E5, which are chamfered, and unchamfered edge parts E1, E2, which are not chamfered and are not rounded. As shown in FIGS. 2 and 3, each of the opposing suction groove 118, the opposing discharge groove 114 and the discharge passage 117 is chamfered along its entire peripheral edge, so that an unchamfered edge part is not formed in each of the opposing suction groove 118, the opposing discharge groove 114 and the discharge passage 117.

Each of the unchamfered edge parts E1, E2 is formed as a right-angled edge part. That is, one of two intersecting surfaces, which intersect with each other at a right angle to form the unchamfered edge part E1, E2, extends continuously from and is in parallel with a slide surface of the pump cover 112, along which the inner rotor 120 or the outer rotor 130 slides. The other one of the two intersecting surfaces, which form the unchamfered edge part E1, E2, extends continuously from and is in parallel with an inside wall surface of the suction groove 113, i.e., an inner-side wall surface 1121*a* and an outer-side wall surface 1122*a*, which will be described later with reference to FIG. 7. The unchamfered edge parts E1, E2 are located in a direct-inflow region A of the suction groove 113, which overlaps with the suction passage 112*a* in a view taken in a direction of the rotational axis, such that the unchamfered edge part E1 is located at a radially outer-side part of the edge E, and the unchamfered edge part E2 is located at a radially inner-side part of the edge E that is opposed to the radially outer-side part of the edge E in the radial direction.

A portion of the suction groove 113, which is located in the direct-inflow region, will be referred to as a direct-inflow portion 1131. Other portions of the suction groove 113, which are located in other regions (peripheral regions B1, B2) that are other than the direct-inflow region A, will be referred to as the peripheral portions 1132. The diagonal lines in the peripheral regions B1, B2 of FIG. 2 indicate the extents of the peripheral portions 1132.

Each of the unchamfered edge parts E1, E2 is angled at 90 degrees (the right angle). In contrast, each of the chamfered edge parts E3, E4, E5 is shaped to tilt at 45 degrees, i.e., is pitched at 45 degrees (see FIG. 7). That is, the tilt surface of each chamfered edge part E3, E4, E5 is tilted at 45 degrees relative to the slide surface of the pump cover 112 and is tilted at 45 degrees relative to the inside wall surface of the suction groove 113 (relative to the corresponding one of the inner-side wall surface 1121*a* and the outer-side wall surface 1122*a* described later). Each of the chamfered edge parts E3, E4, E5 is located in a corresponding one of the peripheral regions B1, B2, which are other than the direct-inflow region A. Furthermore, each of the chamfered edge parts E3 is located at a radially outer side of the corresponding one of the peripheral edge regions B1, B2 in the radial direction of the rotational axis. Each of the chamfered edge parts E4 is located at a radially inner side of the corresponding one of the peripheral edge regions B1, B2 in the radial direction of the rotational axis. The edge parts E5 are located at the start end part 113*c* and the terminal end part 113*d*, respectively.

As discussed above, the unchamfered edge parts E1, E2 are located in the direct-inflow region A. Furthermore, connections Er (see FIG. 6), each of which directly connects between a corresponding one of the chamfered edge parts E3, E4, E5 and a corresponding one of the unchamfered edge parts E1, E2, are also located in the direct-inflow region A. Each of the connections Er is shaped into a curved form, which is recessed in an enlarging direction of the width of the suction groove 113, in the view taken in the direction of the rotational axis. A radial extent (a width w1) of the direct-inflow portion 1131 is larger than a radial extent (a width w2) of the peripheral portion 1132. That is, an outline (contour) of the suction groove 113 is shaped to extend in parallel with a rotational path of the external teeth 124*a* and a rotational path of the internal teeth 132*a*. The chamfered edge parts E3, E4 are located on an inner side of the outline of the suction groove 113. Therefore, the width w2 of the peripheral portion 1132 is smaller than a width (a radial extent) of the outline of the suction groove 113, and the width w1 of the direct-inflow portion 1131 coincides with the width of the outline of the suction groove 113.

Next, the manufacturing procedure of the unchamfered edge parts E1, E2, the chamfered edge parts E3, E4, E5 and the connections Er will be described. First of all, the chamfered edge parts E3, E4, E5 are formed from the pump casing 116 side of the pump cover 112 through a cutting process (first step). Thereafter, the groove bottom portion 113*e* is drilled with a drill in a cutting process to communicate the suction groove 113 to the suction passage 112*a*. At the time of executing the cutting process to form the hole (the direct-inflow portion 1131) through the groove bottom portion 113*e*, the unchamfered edge parts E1, E2 and the connections Er are formed (second step).

Figure 7:
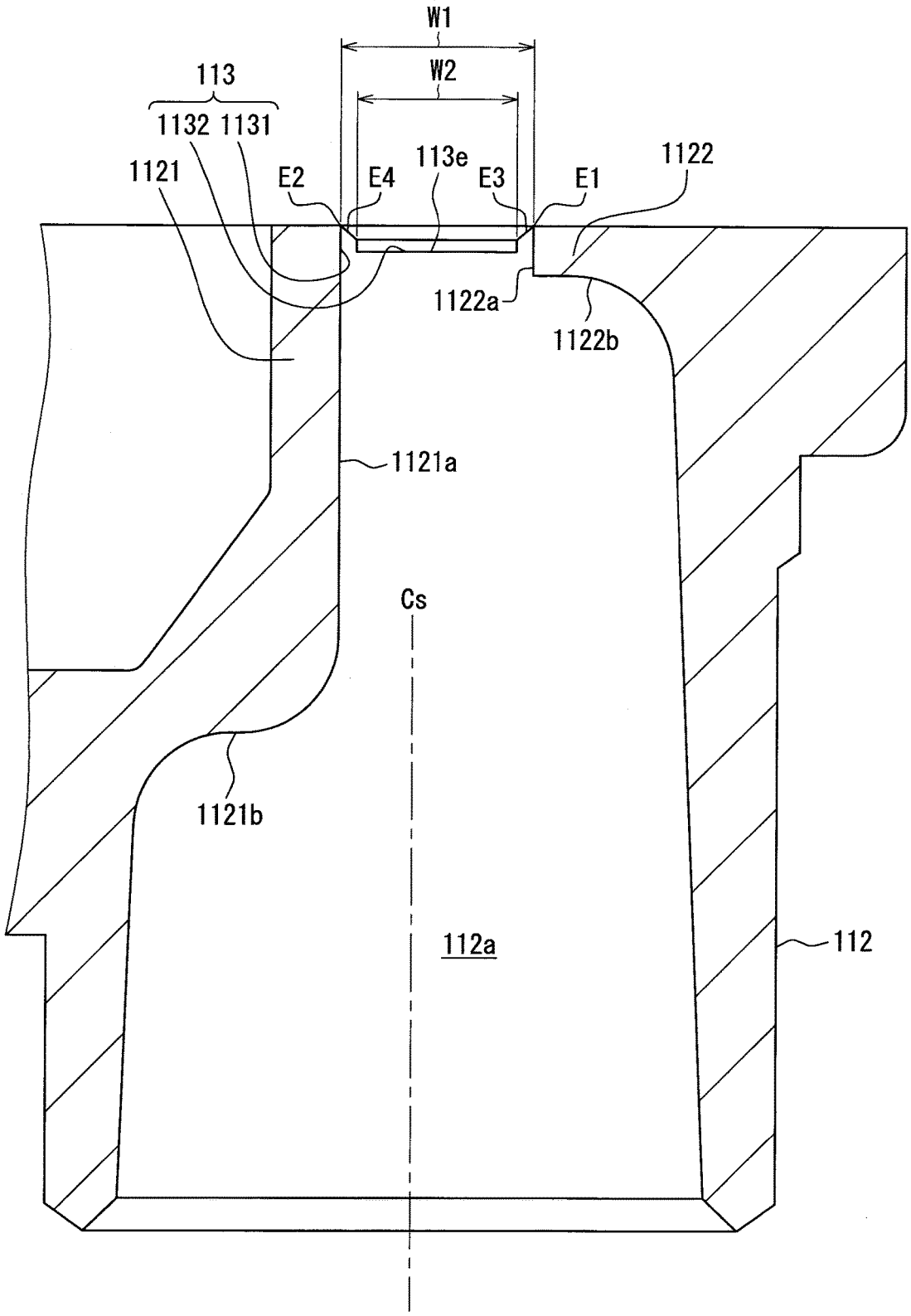
FIG. 7 is an enlarged cross-sectional view of a pump cover shown in FIG. 1

Next, the shape of the suction passage 112*a* will be described with reference to FIG. 7. Although an upstream portion of the suction passage 112*a* has a circular cross section in an axial view, a downstream portion of the suction passage 112*a* is shaped to have a radially inner-side step and a radially outer-side step, which are different from each other. Specifically, in the pump cover 112, a radially inner side of the suction passage 112*a* is formed by an inner-side wall portion 1121, and a radially outer side of the suction passage 112*a* is formed by an outer-side wall portion 1122. The inner-side wall portion 1121 and the outer-side wall portion 1122 have steps 1121*b*, 1122*b*, respectively, which reduce a passage cross-sectional area of the downstream side portion of the suction passage 112*a* in comparison to a passage cross-sectional area of the upstream side portion of the suction passage 112*a*.

A wall surface of the inner-side wall portion 1121, which is located on the downstream side of the step 1121*b*, is referred to as the inner-side wall surface 1121*a*, and a wall surface of the outer-side wall portion 1122, which is located on the downstream side of the step 1122*b*, is referred to as the outer-side wall surface 1122*a*. The inner-side wall surface 1121*a* and the outer-side wall surface 1122*a* extend in parallel with a suction center line Cs of the upstream portion of the suction passage 112*a*. The suction center line Cs is parallel with the inner center line Ci and the outer center line Co. An axial length of the inner-side wall surface 1121*a* is set to be larger than an axial length of the outer-side wall surface 1122*a*. For example, the axial length of the inner-side wall surface 1121*a* is set to be at least five times larger than the axial length of the outer-side wall surface 1122*a*.

Thereby, a flow velocity of the fuel, which flows along the inner-side wall surface 1121*a*, is increased in comparison to a flow velocity of the fuel, which flows along the outer-side wall surface 1122*a*. That is, there is formed a flow velocity distribution in the direct-inflow portion 1131 of the suction groove 113 such that the flow velocity of the fuel at the radially inner-side part of the direct-inflow portion 1131 is higher than the flow velocity of the fuel at the radially outer-side part of the direct-inflow portion 1131.

Advantages of the present embodiment will now be described.

In the present embodiment, the edge E of the portion of the pump housing 110, which forms the suction groove 113, includes the chamfered edge parts E3, E4, E5, which are chamfered, and the unchamfered edge parts E1, E2, which are not chamfered and are not rounded. Each of the unchamfered edge parts E1, E2 is located in the direct-inflow region A, and each of the chamfered edge parts E3, E4, E5 is located in the corresponding one of the peripheral regions B1, B2, which are other than the direct-inflow region A.

A suction velocity of the fuel in the direct-inflow region A of the suction groove 113 is higher than a suction velocity of the fuel in the peripheral regions B1, B2. Therefore, in comparison to the fuel, which flows from the peripheral region B1 into the pump chamber 140, the fuel, which flows from the direct-inflow region A into the pump chamber 140, is more likely to generate cavitation. Therefore, it is advantageous to form the unchamfered edge part(s) in the edge E of the direct-inflow region A for the purpose of limiting or reducing the cavitation to improve the pump efficiency.

In contrast, it is advantageous to chamber the part(s) of the edge E, which is located in the peripheral region B1, to reduce the pump loss at the time of distributing the fuel (fluid) from the suction groove 113 to the pump chamber 140 and thereby to improve the pump efficiency. A main flow direction of the fuel (direct-inflow fuel), which flows from the direct-inflow region A into the pump chamber 140, is the direction of the rotational axis (axial direction). In contrast, a flow direction of the fuel (peripheral fuel), which flows from the peripheral region B1, B2 into the pump chamber 140, is spread into the radially outer direction, the radially inner direction, the rotational direction and the direction of the rotational axis.

That is, it is effective to limit or reduce the cavitation of the direct-inflow fuel at the direct-inflow region A in terms of the pump efficiency improvement. In contrast, in terms of the pump efficiency improvement, it is effective to prioritize the limiting or reducing of the pressure loss of the peripheral fuel at the peripheral region B1, B2 at the time of distributing the fuel from the peripheral region B1, B2 to the pump chamber 140 over the limiting or reducing of the cavitation.

In view of the above points, according to the present embodiment, the unchamfered edge part E1, which is not chamfered and is not rounded, is located in the direct-inflow region A, and the chamfered edge parts E3 are located in the peripheral regions B1, B2. Therefore, the generation of the cavitation in the direct-inflow fuel can be limited or reduced, and the pressure loss of the peripheral fuel can be limited or reduced. Thus, the pump efficiency can be improved. That is, the flow velocity energy of the discharge fuel can be obtained with the relatively small electric power consumption.

Furthermore, the unchamfered edge parts E1, E2 are located at the radially outer-side part and the radially inner-side part, respectively, of the direct-inflow region A. Therefore, the cavitation of the fuel, which flows along the inner-side wall surface 1121*a*, is reduced, and the cavitation of the fuel, which flows along the outer-side wall surface 1122*a*, is also reduced.

Furthermore, the unchamfered edge parts E1, E2 are formed to increase the radial extent of the passage cross-sectional area of the suction groove 113 by the amount, which corresponds to the radial extent of the chambered edge parts E3, E4. Therefore, since the width w1 of the direct-inflow portion 1131 becomes larger than the width w2 of the peripheral portion 1132, the flow quantity of the direct-inflow fuel can be increased by the amount, which corresponds to a difference between the width w1 of the direct-inflow portion 1131 and the width w2 of the peripheral portion 1132.

Furthermore, in the present embodiment, the connections Er, each of which connects between the corresponding chamfered edge part E3, E4 and the corresponding unchamfered-edge part E1, E12, are located in the direct-inflow region A. Therefore, at the time of forming the unchamfered edge parts E1, E2 and the connections Er through the cutting process in the direct-inflow region A after chamfering of all of the direct-inflow region A and the peripheral regions B1, B2, the cutting process of forming the unchamfered edge parts E1, E2 and the connections Er can be executed in the state where a drill bit of the drill is held in the suction passage 112*a*. Therefore, the processability of the unchamfered edge parts E1, E2 and the connections Er can be improved.

Other Embodiments

The present disclosure has been described with respect to the one embodiment. However, the present disclosure is not limited to the above embodiment, and the above embodiment may be modified in various ways within a principal of the present disclosure.

Figure 6:
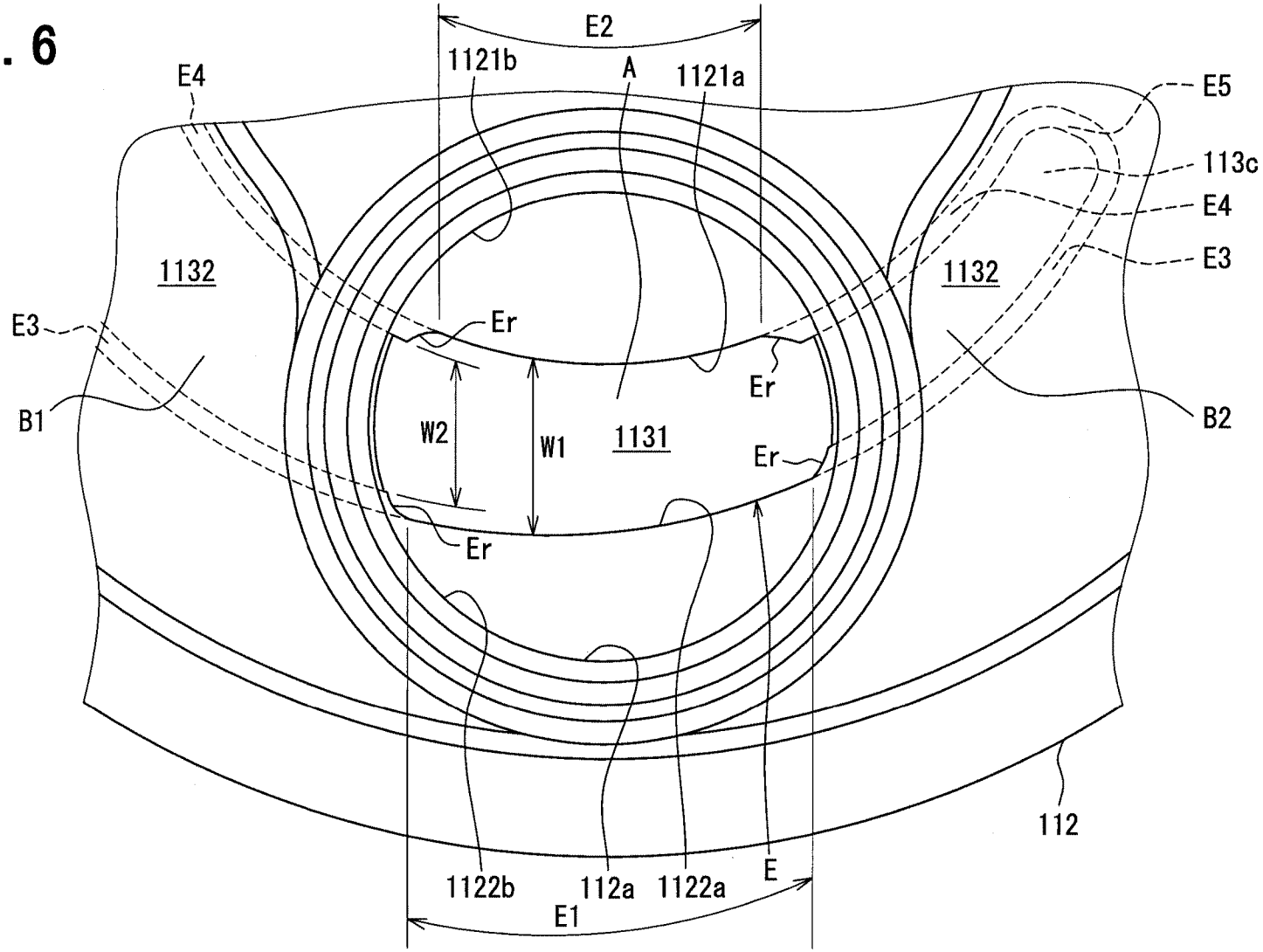
FIG. 6 is a partial enlarged view of FIG. 5.

In the embodiment shown in FIG. 6, the unchamfered edge parts E1, E2 are located at the radially outer-side part and the radially inner-side part, respectively, of the direct-inflow region A. Alternatively, the unchamfered edge part may be formed only at one of the radially outer-side part and the radially inner-side part of the direct-inflow region A, and the other one of the radially outer-side part and the radially inner-side part of the direct-inflow region A may be chamfered.

In the embodiment shown in FIG. 6, the connections Er and the unchamfered edge parts E1, E2 are formed from the pump casing 116 side of the pump cover 112 through the cutting process. Alternatively, the connections Er and the unchamfered edge parts E1, E2 may be formed from the opposite side of the pump cover 112, which is opposite from the pump casing 116.

In the embodiment shown in FIG. 4, the external teeth 124*a* and the internal teeth 132*a* are shaped to have the trochoid tooth profile. Alternatively, the external teeth 124*a* and the internal teeth 132*a* may be shaped to have any other suitable type of tooth profile, such as a cycloid tooth profile or a profile of a combination of various curved lines.

The subject fluid to be pumped with the fluid pump 101 is not limited to the light oil (diesel fuel) and may be any other liquid fuel, such as gasoline or alcohol. Furthermore, the subject fluid to be pumped with the fluid pump 101 is not limited to the fuel and may be liquid, such as hydraulic oil used in a hydraulic actuator or any of various lubricant oils. The fluid pump 101 is not limited to the fluid pump installed in the vehicle.

In the embodiment shown in FIG. 1, the present disclosure is implemented in the fluid pump 101 that has the pump main body 103 and the electric motor 104, which are integrated together. However, the electric motor 104 may not be provided in the fluid pump 101 of the present disclosure, and the electric motor 104 may be formed separately from the rest of the fluid pump 101. In the embodiment shown in FIG. 1, the inner rotor 120 is driven by the electric motor 104. Alternatively, the inner rotor 120 may be driven to rotate by a portion of a drive force for driving the vehicle, such as a drive force of a crankshaft of an internal combustion engine of the vehicle.

In the embodiment shown in FIG. 1, the discharge passage 117 is located on the opposite side of the pump housing 110, which is opposite from the suction passage 112*a* in the axial direction. Alternatively, the discharge passage 117 and the suction passage 112*a* may be placed on the same axial side of the pump housing 110.

What is claimed is:

1. A fluid pump comprising:

an inner rotor that has a plurality of external teeth;

an outer rotor that has a plurality of internal teeth for meshing with the plurality of external teeth;

a pump housing that receives the outer rotor and the inner rotor and forms a plurality of pump chambers, each of which has a variable volume, between the plurality of internal teeth and the plurality of external teeth;

a suction passage that is formed in the pump housing and conducts the fluid to be drawn into at least one of the plurality of pump chambers; and a suction groove that is formed in an inside wall surface of the pump housing and is communicated with the suction passage while the suction groove is shaped to extend along a rotational path of the plurality of external teeth and a rotational path of the plurality of internal teeth, wherein:

an edge of the suction groove comprising a chamfered edge portion, which is chamfered, and an unchamfered edge portion, which is not chamfered and is not rounded;

the unchamfered edge portion is located in a direct-inflow region of the suction groove, which overlaps with the suction passage in a view taken in a direction of a rotational axis; and the chamfered edge portion is located in a peripheral region of the suction groove, which is other than the direct-inflow region.

2. The fluid pump according to claim 1, wherein the unchamfered edge portion is formed in both of a radially inner-side portion of the edge and a radially outer-side portion of the edge, which are opposed to each other in a radial direction, in the direct-inflow region.

3. The fluid pump according to claim 1, wherein a connection, which directly connects between the chamfered edge portion and the unchamfered edge portion, is located in the direct-inflow region.

4. The fluid pump according to claim 1, wherein the unchamfered edge portion is a right-angled edge portion.

* * * * *